United States Patent [19]

Bartuska et al.

[11] Patent Number: 4,487,841

[45] Date of Patent: Dec. 11, 1984

[54] MATERIAL FOR PLASMA SPRAYING AND METHOD OF MAKING SAME

[75] Inventors: Miloslav Bartuska; Petr Kroupa; Josef Szabo; Karel Zverina, all of Prague, Czechoslovakia

[73] Assignee: Vysoka skola chemicko-technologicka, Prague, Czechoslovakia

[21] Appl. No.: 348,227

[22] Filed: Feb. 12, 1982

Related U.S. Application Data

[63] Continuation of Ser. No. 155,078, Jun. 2, 1980, abandoned.

[51] Int. Cl.[3] ..... C04B 35/04; C04B 35/10; C04B 35/12; C04B 35/14

[52] U.S. Cl. ..... 501/105; 501/117; 501/121; 501/122; 501/125; 501/132

[58] Field of Search ..... 106/57, 63; 501/121, 501/122, 132, 117, 125, 105

[56] References Cited

U.S. PATENT DOCUMENTS

| | | | |
|---|---|---|---|
| 3,274,007 | 9/1966 | Jones | 106/57 |
| 3,541,193 | 11/1970 | Adams | 106/57 |
| 3,565,645 | 2/1971 | Anderson | 106/57 |
| 3,567,473 | 3/1971 | Drever et al. | 106/57 |
| 3,576,653 | 4/1971 | Miller et al. | 106/63 |
| 3,625,717 | 12/1971 | Grubba et al. | 106/57 |
| 3,645,894 | 2/1972 | Krystyniak | 106/57 |
| 4,053,321 | 10/1977 | Okumiya et al. | 106/57 |
| 4,141,743 | 2/1979 | Grubba | 106/57 |

*Primary Examiner*—Mark Bell

[57] ABSTRACT

There is disclosed a material for hot or plasma spraying, especially a material based on oxide ceramics, and a process for the production thereof. The composition of the invention is a mixture of powdered oxides containing at least two fundamental oxides with high melting point, and at least one glass-forming oxide the melting point of which is lower. The invention also includes a process for the production of such composition by the melting and agglomeration of individual components in the oxidizing medium of a plasma stream, including the special treatment of the starting components.

5 Claims, No Drawings

MATERIAL FOR PLASMA SPRAYING AND METHOD OF MAKING SAME

This application is a continuation of application Ser. No. 155,078, filed June 2, 1980, now abandoned.

The invention relates to a material for hot or plasma spraying, especially to non-metallic refractory material suitable for the formation of resistant coatings, and to a process for the production of such a material.

At present, miscellaneous metallic and non-metallic materials are used for the production of protective coatings; the composition of the materials is varied according to the required properties of the coating regarding the chemical composition of starting materials and their physical properties. Such properties are especially refractoriness, abrasive wear resistance, minimum porosity, good holding on subjacent material, and resistance to mechanical and thermal impacts as well as chemical resistance to the influence of surrounding media. A problem still remains in realizing all the desired properties in one coating.

For example, metallic, especially noble, materials such as chromium, titanium, nickel and the like, even refined with another additive or alloy additions, if necessary, are used. With these materials, it follows from the properties of their starting components that very good mechanical properties of the resulting coatings are achieved, but heat resistance or chemical resistance of the resulting thus coating made is usually substantially worse.

Another large group of spraying materials are non-metallic materials, especially those based on oxide ceramics where the spraying material is made up either from one oxide or from a mixture of several oxides in the proper ratio. Typical representatives of these materials are materials on the basis of aluminum oxide $Al_2O_3$ whose characteristic feature is the composition of the coating made from a mixture of gamma and alpha $Al_2O_3$ modification. At temperature above 1180° C. irreversible modification transformation of the $Al_2O_3$ gamma modification to the alpha modification takes place; at the same time there is a permanent contraction of the coating and an increase of its density. Coatings on the basis of $Al_2O_3$, the so-called corundum coatings, are characterized by extraordinary abrasive wear resistance, high adhesion to subjacent material, and by very good electric properties; their corrosion resistance is, however, lower as a result of their open porosity, which amounts to 6 to 8%, and after transformation to the alpha modification it increases to 9 to 10%. Coatings on the basis of zirconium oxide $ZrO_2$ have especially excellent heat insulating properties; layers made from chromium oxide $Cr_2O$ are very hard and abrasive wear resistant; coatings of titanium oxide $TiO_2$ are compact and readily machinable, and there are very hard layers, for example, layers of hafnium oxide $HfO_2$. A common disadvantage of these one-component spraying materials is, however, their relatively high porosity, and from it a resulting smaller resistance to influence of aggressive media.

This disadvantage is partially overcome by coatings on the basis of silicium oxide $SiO_2$ which forms a compact coating with a very small coefficient of thermal expansion and zero porosity. This coating is considerably resistant to corrosion and sudden temperature changes; on the other hand its resistance to mechanical impacts is entirely insufficient.

The problem of improving properties of plasma coatings has been lately solved by the formation of a mixture of several oxides exhibiting in the proper ratio more convenient properties than the properties of the basic components. It is, for example, zirconium silicate $ZrSiO_4$ in which in coating composition $ZrO_2$ prevails in its volume stable tetragonal modification in a homogeneous mixture with $SiO_2$ in glass form. At temperatures above 1150° C. zircon is reversely synthetized. The coating has excellent resistance to temperature changes, a good heat insulating power, and it resists very well corrosion by melted glass materials, slags and by colored metals due to poor wetting of the zircon by the above-mentioned melts. The general corrosion resistance is, however, negatively influenced because of the open porosity of the coating, 15 to 25%, in spite of the presence of glass in the form of $SiO_2$.

From further multi-component spraying materials, for example, magnesia spinel $MgAl_2O_4$ can be formed; it has a low porosity, high electrical resistance, and excellent adhesion to subjacent material, but its corrosion resistance is substantially lower. There are also a number of multicomponent spraying materials on the basis of $Al_2O_3$ with additives of $TiO_2$ or $Cr_2O3$ where a $TiO_2$ addition increases especially the compactness of the coating with a simultaneous improvement of the resistance to temperature changes, and a $Cr_2O_3$ addition ensures better abrasive wear resistance; however, other disadvantages are not influenced.

Finally, the use of $Al_2O_3$ with the addition of $SiO_2$ is also known. This spraying material retains the very good mechanical properties of corundum ($Al_2O_3$) coatings; the presence of $SiO_2$ also enhancing corrosion resistance. With regard to the mechanism of transformation of the gamma and alpha $Al_2O_3$ modifications, however, not even here as a result of the negative influencing of resulting coating porosity can there be achieved a corrosion resistance comparable with protective $SiO_2$ layers.

This result, with the simultaneous achieving of high refractoriness, abrasive wear, and resistance to sudden temperature changes is the main object of the present invention.

A further possible way of lowering the porosity of the coating and thus to increase corrosion resistance is a choice of the proper granulation of starting spraying material, or the use of an amorphous additive as, for example, zinc by which, however, the hardness and heat resistance of the coating again becomes worse. Known two-component coatings with an amorphous additive do not make it possible to attain a sufficient resistance to corrosion medium of a given composition.

As concerns the process of the production of spraying material for hot or plasma spraying there are used altogether traditional ways of the treatment by the melting of the starting materials or their mixtures in arc furnaces and by the subsequent treatment to produce the desired granularity and shape of the material proper for its application by use of a plasma burner. These processes are considerably uneconomical with respect to relatively small treated amounts of material, especially with respect to high melting temperatures of the usual spraying materials. Besides, with the treatment of materials alloyed with small amounts of additives to very small grains of the size usual in the spraying by plasma stream it has been discovered that the heterogeneities in the structure of material negatively influence the quality of the coatings produced.

There is known as well a substantially power-consuming alloying of spraying materials by the diffusion of corresponding additives under high temperatures or the granulation of the mixture grains of individual components for the production of spraying materials consisting of two or more fundamental components contained in the mixture in a relatively high weight ratio. There is also known a process in which the relatively large grains of one or more components are enveloped by very fine additives with a grain size smaller than 0.3 micrometer. However, not even these processes comply with the requirement of a high homogenity of the spraying materials.

The above-mentioned disadvantages of prior art spraying materials for hot or plasma spraying are overcome by the spraying material of the present invention; such material consists of several metal oxides of which at least one oxide is a glass-forming oxide. In accordance with the invention the spraying material is formed by agglomerates of at least two fundamental oxides, especially $Al_2O_3$, MgO, CaO, BaO, $Cr_2O_3$, $TiO_2$ or $ZrO_2$, in the total amount of 50 to 99% by weight, and by at least one glass-forming oxide with a melting point lower by about 50° to 1100° C. than the melting points of the fundamental oxides, such glass-forming oxide being preferably $SiO_2$, in the amount of 1 to 50% by weight. The spraying material preferably contains agglomerates of (1) 50 to 80% by weight CaO, 1 to 5% by weight MgO, and 18 to 45% by weight $SiO_2$, or (2) 50 to 90% by weight MgO, 1 to 5% by weight CaO, and 5 to 45% by weight $SiO_2$, or (3) 90 to 95% by weight $Cr_2O_3$, 2 to 8% by weight $TiO_2$, and 1 to 3% by weight $SiO_2$, or (4) 65 to 75% by weight $Cr_2O_3$, 20 to 30% by weight MgO, and 2 to 10% by weight $SiO_2$, or (5) 30 to 40% by weight $Al_2O_3$, 15 to 25% by weight CaO, and 35 to 50% by weight $SiO_2$, or (6) 25 to 30% by weight $Al_2O_3$, 40 to 45% by weight BaO, and 25 to 35% by weight $SiO_2$, or (7) 46 to 51% by weight $Al_2O_3$, 33 to 41% by weight $ZrO_2$, and 8 to 21% by weight $SiO_2$, or (8) 25 to 30% by weight $Al_2O_3$, 25 to 30% by weight $Cr_2O_3$, 25 to 30% by weight $ZrO_2$, and 10 to 25% by weight $SiO_2$.

The above-mentioned disadvantages of prior art processes for the production of spraying materials for hot or plasma spraying consisting of several metal oxides from which at least one oxide is a glass-forming oxide are overcome by the process according to the invention, wherein the fundamental oxides and glass-forming oxide are brought separately or in a previously prepared mixture into the plasma stream with a concentration of charged particles between $2.00\times10^{24}$ and $0.3\times10^{23}$ per $cm^3$ in the water stabilized plasma they are partially melted or melted-down and the resulting agglomerates are captured, for example, by a water or an air screen. The process according to the invention is preferably carried out so that into the plasma stream there is brought a mixture of fundamental oxides with a particle size of 0.01 to 0.2 mm and a glass-forming oxide or oxides with a particle size of 0.0002 to 0.04 mm. The particles of the fundamental oxides are surface melted and the particles of the glass-forming oxide or oxides are melted-down, or so that the fundamental oxides and the glass-forming oxide or oxides are brought separately or in a previously prepared mixture into the plasma stream with a concentration of charged particles between $2.00\times10^{24}$ and $0.3\times10^{23}$ per $cm^3$ especially into a water stabilized plasma. In such partially melted or melted-down condition the particles are applied directly onto the surface which is to be protected by the coating.

The invention is further explained in the following examples of concrete embodiments thereof.

EXAMPLE 1

Into the plasma stream of a water stabilized plasma burner adapted for the spraying of powdered materials there is introduced a mixture of 65% by weight of powdered CaO with a particle size 0.04 to 0.06 mm, 3% by weight of MgO with the same particle size, and 32% by weight of $SiO_2$ with a particle size 0.0005 to 0.0008 mm. The individual particles are exposed to temperature between 15,000° and 60,000° C., and after relevant reactions take place they are captured by a water screen. The resulting agglomerates are formed predominantly of dicalcium silicate accompanied by a small amount of monticellite ($CaMgSiO_4$) as a binding phase and smaller amount of a glass phase.

EXAMPLE 2

Into the plasma stream there are introduced 70% by weight of MgO and 2% by weight of CaO in a mixture with 28% by weight of $SiO_2$ under conditions analogous to those employed in Example 1. The materials are applied to the surface of a preheated constructional component, and they are allowed to cool slowly. The resulting material of the coating is formed by forsterite accompanied by small amounts of periclase (MgO), monticellite and a glass phase.

EXAMPLE 3

For spraying carried out under conditions analogous to Example 1, 95% by weight of $Cr_2O_3$, 3% by weight of $TiO_2$, and 2% by weight of $SiO_2$ are used. The resulting material is formed mostly by eskolaite ($Cr_2O_3$) and a small amount of a glass phase.

EXAMPLE 4

70% by weight of $Cr_2O_3$, 25% by weight of MgO, and 5% by weight of $SiO_2$ are used, the spray being formed as in Example 1. The resulting material is mostly formed by chrompicotite accompanied by a small amount of forsterite ($Mg_2SiO_4$) and of a glass phase.

EXAMPLE 5

36% by weight of $Al_2O_3$, 20% by weight of CaO, and 44% by weight of $SiO_2$ are used in the same manner as in Example 1. A substantial part of resulting material is formed by anorthite ($CaAl_2Si_2O_8$) accompanied with a glass phase.

EXAMPLE 6

27% by weight of $Al_2O_3$, 41% by weight of BaO, and 32% by weight of $SiO_2$ are used in the same manner as in Example 1. The resulting material is mostly formed by celsian ($BaO.Al_2.O_3.2SiO_2$) accompanied by a glass phase.

EXAMPLE 7

28% by weight of $Al_2O_3$, 28% by weight of $Cr_2O_3$, 28% by weight of $ZrO_2$, and 16% by weight of $SiO_2$ are used in the same manner as in Example 1. The resulting material is mostly formed by corundum accompanied with baddeleyite ($ZrO_2$), mullite ($3Al_2O_3.2SiO$) and a glass phase.

EXAMPLE 8

28% by weight of $Al_2O_3$, 28% by weight of $Cr_2O_3$, 28% by weight of $ZrO_2$, and 16% by weight of $SiO_2$ are used in the same manner as in Example 1. The resulting material consists of approximately equal parts of baddeleyite, ruby ($Al_2O_3$) and eskolaite accompanied by a smaller amount of a glass phase.

The materials prepared according to the above-described examples give the security of high refractoriness, resistance to corrosion by metallic or non-metallic melts, abrasive wear resistance, and resistance to sudden changes of temperature. All of such examples employ new materials of proper composition and properties always containing definite amounts of glass phase of $SiO_2$ which substantially increases the corrosion resistance of the coating. Besides this glass phase, there is also always present a crystalline phase the physical and chemical properties of which are co-decisive for the maximum resistance of the coating to a corrosive medium of a given composition, and which is formed at least by two fundamental oxides with respect to the necessity of a sufficiently fine choice of its properties.

High homogeneity of the coating even with relatively small amounts of some additives is achieved by the capture of the resulting agglomerates by water or air screen and by their application to a substrate using a plasma burner. All of the above-mentioned spraying materials can, with very good results, be put directly on the surface which is to be protected by the coating, practically non-porous coatings being obtained with very good mechanical properties by the choice of proper percentile content and size of the $SiO_2$ particles, as set forth above.

Although obviously not limited thereto, the plasma burner employed in practicing the method of the invention can advantageously be carried out by use of a plasma burner in accordance with that disclosed and claimed in Bartuska et al application Ser. No. 144,168, filed Apr. 25, 1980 (now abandoned), and the continuation-in-part thereof, Ser. No. 206,979, filed Nov. 14, 1980, now U.S. Pat. No. 4,338,509.

Although the invention is described with reference to a plurality of preferred embodiments thereof, it is to be expressly understood that it is in no way limited to the disclosure of such a plurality of embodiments, but is capable of numerous modifications within the scope of the appended claims.

We claim:

1. In a spraying material for hot or plasma spraying consisting of several metal oxides of which at least one oxide is a glass-forming oxide, the improvement wherein the material is formed by agglomerates selected from one of the groups consisting of:

(1) 50% to 80% by weight of CaO, 1% to 5% by weight of MgO, and 18% to 45% by weight of $SiO_2$;

(2) 50% to 90% by weight of MgO, 1% to 5% by weight of CaO, and 5% to 45% by weight of $SiO_2$;

(3) 90% to 95% by weight of $Cr_2O_3$, 2% to 8% by weight of $TiO_2$, and 1% to 3% by weight of $SiO_2$;

(4) 65% to 75% by weight of $Cr_2O_3$, 20% to 30% by weight of MgO, and 2% to 10% by weight of $SiO_2$;

(5) 30% to 40% by weight of $Al_2O_3$, 15% to 25% by weight of CaO, and 35% to 50% by weight of $SiO_2$;

(6) 25% to 30% by weight of $Al_2O_3$, 40% to 45% by weight of BaO, and 25% to 35% by weight of $SiO_2$;

(7) 46% to 51% by weight of $Al_2O_3$, 33% to 41% by weight of $ZrO_2$, and 8% to 21% by weight of $SiO_2$; and (8) 25% to 30% by weight of $Al_2O_3$, 25% to30% by weight of $Cr_2O_3$, 25% to 30% by weight of $ZrO_2$ and 10% to 25% by weight of $SiO_2$;

said glass-forming oxide being $SiO_2$ having a particle size of 0.0002 to 0.04 mm, and the other metal oxides being fundamental oxides having a particle size of 0.01 to 0.2 mm.

2. In a process for the production of hot plasma spraying material consisting of several metal oxides of which at least one oxide is a glass-forming oxide, the improvement wherein the material is formed by agglomerates selected from one of the groups consisting of:

(1) 50% to 80% by weight of CaO, 1% to 5% by weight of MgO, and 18% to 45% by weight of $SiO_2$;

(2) 50% to 90% by weight of MgO, 1% to 5% by weight of CaO, and 5% to 45% by weight of $SiO_2$;

(3) 90% to 95% by weight of $Cr_2O_3$, 2% to 8% by weight of $TiO_2$, and 1% to 3% by weight of $SiO_2$;

(4) 65% to 75% by weight of $Cr_2O_3$, 20% to 30% by weight of MgO, and 2% to 10% by weight of $SiO_2$;

(5) 30% to 40% by weight of $Al_2O_3$, 15% to 25% by weight of CaO, and 35% to 50% by weight of $SiO_2$;

(6) 25% to 30% by weight of $Al_2O_3$, 40% to 45% by weight of BaO, and 25% to 35% by weight of $SiO_2$;

(7) 46% to 51% by weight of $Al_2O_3$, 33% to 41% by weight of $ZrO_2$, and 8% to 21% by weight of $SiO_2$; and (8) 25% to 30% by weight of $Al_2O_3$, 25% to 30% by weight of $Cr_2O_3$, 25% to 30% by weight of $SrO_2$ and 10% to 25% by weight of $SiO_2$;

said glass-forming oxide being $SiO_2$ having a particle size of 0.0002 to 0.04 mm, and the other metal oxides being fundamental oxides having a particle size of 0.01 to 0.2 mm; and wherein said fundamental oxides are brought separately or in a previously prepared mixture into the plasma stream with a concentration of charged particles between $2.00\times10^{24}$ and $0.3\times10^{23}$ per $cm^3$ into a water stabilized plasma, are partially melted or melted-down, and the resulting agglomerates are captured.

3. In a spraying material for hot or plasma spraying consisting of several metal oxides of which at least one oxide is a glass-forming oxide, the improvement wherein the material is formed by agglomerates consisting of 25% to 30% by weight of $Al_2O_3$, 40% to 45% by weight of BaO, and 25% to 35% by weight of $SiO_2$, said glass-forming oxide being $SiO_2$ having aparticle size of 0.0002 to 0.04 mm, and the other metal oxides being fundamental oxides having a particle size of 0.01 to 0.2 mm.

4. In a process for the production of hot or plasma spraying material consisting of several metal oxides of which at least one oxide is a glass-forming oxide, the improvement wherein the material is formed by agglomerates consisting of 25% to 30% by weight of $Al_2O_3$, 40% to 45% by weight of BaO, and 25% to 35% by weight of $SiO_2$, said glass-forming oxide being $SiO_2$ having a particle size of 0.0002 to 0.04 mm, and the other metal oxides being fundamental oxides having a particle size of 0.01 to 0.2 mm, and wherein said fundamental oxides are brought separately or in a previously prepared mixture into the plasma stream with a concentration of charged particles between $2.00 \times 10^{24}$ and $0.3 \times 10^{23}$ per $cm^3$ into a water stabilized plasma, are partially melted or melted-down, and the resulting agglomerates are captured.

5. The process for the production of spraying material according to claim 4, wherein the particles of said fundamental oxides are brought into the plasma stream, said particles of fundamental oxides are simultaneously surface-melted in the said plasma stream, the particles of $SiO_2$ are brought into the said plasma stream also and melted-down and, resulting agglomerates are captured by water screen or by air screen.

* * * * *